US006925831B2

(12) United States Patent
Park et al.

(10) Patent No.: US 6,925,831 B2
(45) Date of Patent: Aug. 9, 2005

(54) UNIT TYPE AIR CONDITIONER

(75) Inventors: Jung Mee Park, Busan-si (KR); W o Sung Chang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/714,666

(22) Filed: Nov. 18, 2003

(65) Prior Publication Data

US 2004/0168461 A1 Sep. 2, 2004

(30) Foreign Application Priority Data

| | | |
|---|---|---|
| Jan. 27, 2003 | (KR) | 2003-0005362 |
| Feb. 25, 2003 | (KR) | 2003-0011813 |
| Feb. 25, 2003 | (KR) | 2003-0011814 |
| Feb. 26, 2003 | (KR) | 2003-0011909 |
| Mar. 5, 2003 | (KR) | 2003-0013821 |

(51) Int. Cl.[7] ..... F25D 23/12
(52) U.S. Cl. ..... 62/262; 62/298
(58) Field of Search ..... 62/262, 298, 404, 62/407, 285

(56) References Cited

U.S. PATENT DOCUMENTS 5,638,693 A * 6/1997 Baek ..... 62/262
5,775,123 A * 7/1998 Wakayama et al. ..... 62/407
6,182,460 B1 * 2/2001 Hernandez et al. ..... 62/262

* cited by examiner

*Primary Examiner*—Melvin Jones
(74) *Attorney, Agent, or Firm*—McKenna Long & Aldridge LLP

(57) ABSTRACT

Unit type air conditioner including a base plate in a bottom part thereof, a front panel forming a front exterior of the air conditioner, having a discharge opening in an upper part thereof, a discharge frame in the discharge opening for controlling flow of the air discharged into the room, a barrier on a center part of the base plate to divide the base plate into indoor side base and an outdoor side base, an air guide on the indoor side base, having an indoor fan mounted therein, a discharge guide for guiding the air passed through the air guide to the discharge frame, and a control box at a side of the air guide for fitting electric components therein, thereby diversifying air flow directions to a room, simplifying indoor fan and indoor motor assembly structure, and improving a structure of the control box for easy maintenance of the electric components, and preventing fire from spreading.

31 Claims, 20 Drawing Sheets

UNIT TYPE AIR CONDITIONER

This application claims the benefit of the Korean Application Nos. P2003-0005362 filed on Jan. 27, 2003, P2003-0011813 filed on Feb. 25, 2003, P2003-0011814 filed on Feb. 25, 2003, P2003-0011909 filed on Feb. 26, 2003, and P2003-0013821 filed on Mar. 5, 2003, which are hereby incorporated by reference.

BACKGROUND OF THE INVENTION

1. Field of the Invention

The present invention relates to a unit type air conditioner.

2. Background of the Related Art

In general, the unit type air conditioner, with an indoor unit and an outdoor unit provided within one unit, is installed in a window of a building for air conditioning a space in the building.

A related art unit type air conditioner will be described, with reference to the attached drawings. FIG. 1 illustrates a disassembled perspective view of a related art unit type air conditioner, and FIG. 2 illustrates a section of a related art unit type air conditioner.

Referring to FIGS. 1 and 2, there are a base plate 1 in a bottom part of the air conditioner, and a barrier 3 on the base plate 1 for dividing an inside part of the air conditioner into an indoor side and an outdoor side. There are first, and second sidewalls at opposite ends of the barrier 3, and a third sidewall 6 between the first, and second sidewalls 5*a,* and 5*b.* The third sidewall 6, fabricated separately from, and fitted to, the barrier 3, divides the indoor side into a part air flows therein, and the other part no air flows therein.

There is a tray 9 on the base plate 1 of the indoor side for receiving condensed water from a surface of an indoor heat exchanger 11. The indoor heat exchanger 11 over the tray 9 makes working fluid in a heat exchange cycle to heat exchange with air drawn from the room.

In the meantime, there is a heat exchanger cover 13 over the indoor heat exchanger 11 having opposite ends supported on the first sidewall 5*a* and the third sidewall 6, respectively. There is a heater 15 in rear of the indoor heat exchanger 11.

There is an indoor fan 17 between the first sidewall 5*a* and the third sidewall 6 for generating an air flow. The indoor fan 17 has one end fixed to a support plate 18 fitted to the first sidewall 5*a,* and the other end connected to a motor 19. The motor 19 is held at a motor supporting part 20 of a metal fitted to the third sidewall 6.

There is a scroll 21 between the indoor fan 17 and the barrier 3. The scroll guides an air flow formed by the indoor fan 17.

In the meantime, there is a panel 23 in a front part of the air conditioner. The panel 23 has a suction grill 24, an air inlet, for drawing air, and an air outlet 25 for discharging air. The air outlet 25 has a guide member 27 for directing air guided by the scroll 21 to a desired direction, and the guide member 27 has louvers 29.

The barrier 3 has a ventilation hole 30 for making the outdoor side and the indoor side in communication selectively to provide fresh air to the indoor side. The ventilation hole 30 has a filter 32 for filtering foreign matters from the air, and a ventilation door 34 for opening/closing the ventilation hole 30.

There are a compressor 48 and an outdoor heat exchanger 38 of the heat exchange cycle on the base plate 1 on the outdoor side. The outdoor heat exchanger 38, joined to a shroud 40 for guiding an air flow formed by the outdoor fan 42, makes the working fluid in the heat exchange cycle to heat exchange with outdoor air.

The outdoor fan 42, between the outdoor heat exchanger 38 and the shroud 40, is connected to a rotation shaft of a motor 46 mounted on a motor mount 44. Meanwhile, the shroud 40 is braced to the barrier 3 with a brace 49.

In the drawing, an unexplained reference numeral 36 denotes a sleeve 36 forming an exterior of the air conditioner, and 22 denotes a top plate.

The operation of the related art air conditioner will be described based on cooling operation thereof.

Upon putting the air conditioner into operation, air circulations between insides to outsides of the air conditioner are formed by the indoor fan 17 and the outdoor fan 42. In this instance, room air is drawn through the suction grill 24 by the indoor fan 17 on the indoor side, and heat exchanges at the indoor heat exchanger 11 to become air of relatively low temperature.

The air passed through indoor heat exchanger 11 is guided to the air outlet 25 by the scroll 21 through the indoor fan 17, passes the guide member 27 where a direction of flow is fixed by the louvers, and is discharged to the room.

On the other hand, on the outdoor side, outdoor air is drawn through a rear surface of the sleeve 36 by the outdoor fan 42, and guided through a space between the shroud 40 and the barrier 3. Then, the outdoor air passes through the outdoor heat exchanger 38 via the outdoor fan 42. In this instance, the outdoor heat exchanger 38 makes the outdoor air to heat exchange with the working fluid in the heat exchange cycle, and discharges heat from the room to an outside of the room.

However, the foregoing related art unit type air conditioner has the following problems.

The air drawn by the indoor fan is discharged to an inside space through the guide member guided by the scroll. However, the scroll and the guide member can not guide the air to different directions due to their nature of structure.

Second, the related art unit type air conditioner has the indoor fan fixed to the support plate. Therefore, separate fabrication of the support plate is required, and assembly is not convenient.

Third, the motor 19 is held at a motor supporting part 20 of a metal fitted to the third sidewall 6. The motor supporting part is fastened to the third sidewall with fastening means, such as screws. Therefore, a process for mounting the motor is complicate. Moreover, since the motor is held only with the motor supporting part, the motor has not been held, rigidly.

SUMMARY OF THE INVENTION

Accordingly, the present invention is directed to a unit type air conditioner that substantially obviates one or more of the problems due to limitations and disadvantages of the related art.

An object of the present invention is to provide a unit type air conditioner in which a discharge guide is used for discharging air to different directions.

Other object of the present invention is to provide a unit type air conditioner, in which mounting of an indoor fan and indoor motor is simple, and the indoor fan can be mounted without any separate component.

Another object of the present invention is to provide a unit type air conditioner, in which capacitors and electric components are provided to a separate space, for better performance of the air conditioner, and preventing spreading of fire an environment.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the unit type air conditioner includes a base plate in a bottom part thereof, a front panel forming a front exterior of the air conditioner, having a discharge opening in an upper part thereof, a discharge frame in the discharge opening for controlling flow of the air discharged into the room, a barrier on a center part of the base plate to divide the base plate into indoor side base and an outdoor side base, an air guide on the indoor side base, having an indoor fan mounted therein, and a discharge guide for guiding the air passed through the air guide to the discharge frame.

The discharge guide has an upper section larger than a lower section, and the discharge guide includes a plurality of fastening parts engaged with the front panel, and a first rim engaged with the discharge frame in an upper part thereof.

The discharge guide includes a second rim in a lower part thereof, and the air guide includes mounting ribs 355 to be engaged with the second rim.

In other aspect of the present invention, there is provided a unit type air conditioner including a base plate in a bottom part thereof, a front panel forming a front exterior of the air conditioner, having a discharge opening in an upper part thereof, a discharge frame in the discharge opening for controlling flow of the air discharged into the room, a barrier on a center part of the base plate to divide the base plate into indoor side base and an outdoor side base, and an upper air guide, and a lower air guide on the indoor side base, having an indoor fan mounted therein, for guiding air drawn therein by the indoor fan.

The indoor fan has one side connected to the indoor motor, and the other side held at a bearing assembly. The bearing assembly includes a bearing and a bearing cover surrounding the bearing.

The bearing assembly is held in the upper and lower air guide. For this, the lower air guide includes a semi-circular supporting part for holding the bearing assembly, and the upper air guide includes a second supporting part engaged with the first supporting part.

The first supporting part includes a circumferential extension projected therefrom for prevention of the bearing assembly from breaking away, and the second supporting part includes a circular slot to be engaged with the circumferential extension. The first supporting part includes a flat surface in an upper part or a lower part.

The first and second supporting parts include semi-circular projections from insides thereof respectively for inserting in the bearing assembly, and the bearing assembly includes an insertion groove in an outside circumferential surface thereof.

The lower air guide includes guide parts in a lower part thereof, and the upper air guide includes channel parts slidably inserted in the guide parts respectively.

The lower air guide includes tips on upper parts of opposite side surfaces respectively, and the upper air guide includes fastening holes engaged with the tips respectively.

The lower air guide includes guide parts in a lower part thereof, and the upper guide includes inwardly bent stepped parts for slidably inserting into the guide parts.

The lower air guide includes a semi-circular first motor supporting part for holding an end of the indoor motor, and the upper air guide includes a second motor supporting part engaged with the first motor supporting part. The indoor motor is mounted on an indoor motor mounting part having a semi-circular mounting surface.

In another aspect of the present invention, there is provided a unit type air conditioner including a base plate in a bottom part thereof, a front panel forming a front exterior of the air conditioner, having a discharge opening in an upper part thereof, a discharge frame in the discharge opening for controlling flow of the air discharged into the room, a barrier on a center part of the base plate to divide the base plate into indoor side base and an outdoor side base, an air guide on the indoor side base, having an indoor fan mounted therein, and a discharge frame having grill parts for discharging air guided to a discharge opening by the air guide to opposite side parts, and a discharge grill between the grill parts for controlling an air flow direction.

The discharge grill is preferably detachable. The discharge grill includes a plurality of horizontal bars and vertical ribs under the horizontal bars for guiding air flow.

In further aspect of the present invention, there is provided a unit type air conditioner including a base plate in a bottom part thereof, a front panel forming a front exterior of the air conditioner, having a discharge opening in an upper part thereof, a discharge frame in the discharge opening for controlling flow of the air discharged into the room, a barrier on a center part of the base plate to divide the base plate into indoor side base and an outdoor side base, an air guide on the indoor side base, having an indoor fan mounted therein, and a control box at a side of the air guide, having a body for fitting electric components therein, and a first cover for selective opening/closing of the body.

The body includes first hooks, and the first cover includes first fastening slots for fastening with the first hooks.

The first cover includes a first holding part for holding the capacitor therein, and a second holding part for fixing wires connected to the capacitor, and the first holding part includes a base plate for supporting a bottom of the capacitor, and a holder for surrounding an outside circumferential surface of the capacitor.

The second holding part includes a detachable second cover fitted thereto for protecting wires. The second holding part includes a second hook on a top thereof, and the second cover includes a second fastening slot on a top thereof for fastening to the second hook.

The second holding part includes first fastening members in a lower part thereof, and the second cover includes second fastening members for fastening to the first fastening members.

The first fastening member includes a stopper projected from an underside thereof, and the second fastening member includes an inserting channel for inserting the first fastening member, and a cut away part for holding the stopper.

The indoor motor has one side connected to the indoor fan, and the other side held at the control box. The control box includes a body for fitting electric components therein, having a motor cover for holding the indoor motor, and a first cover for selective opening/closing of the body.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Figure 1:
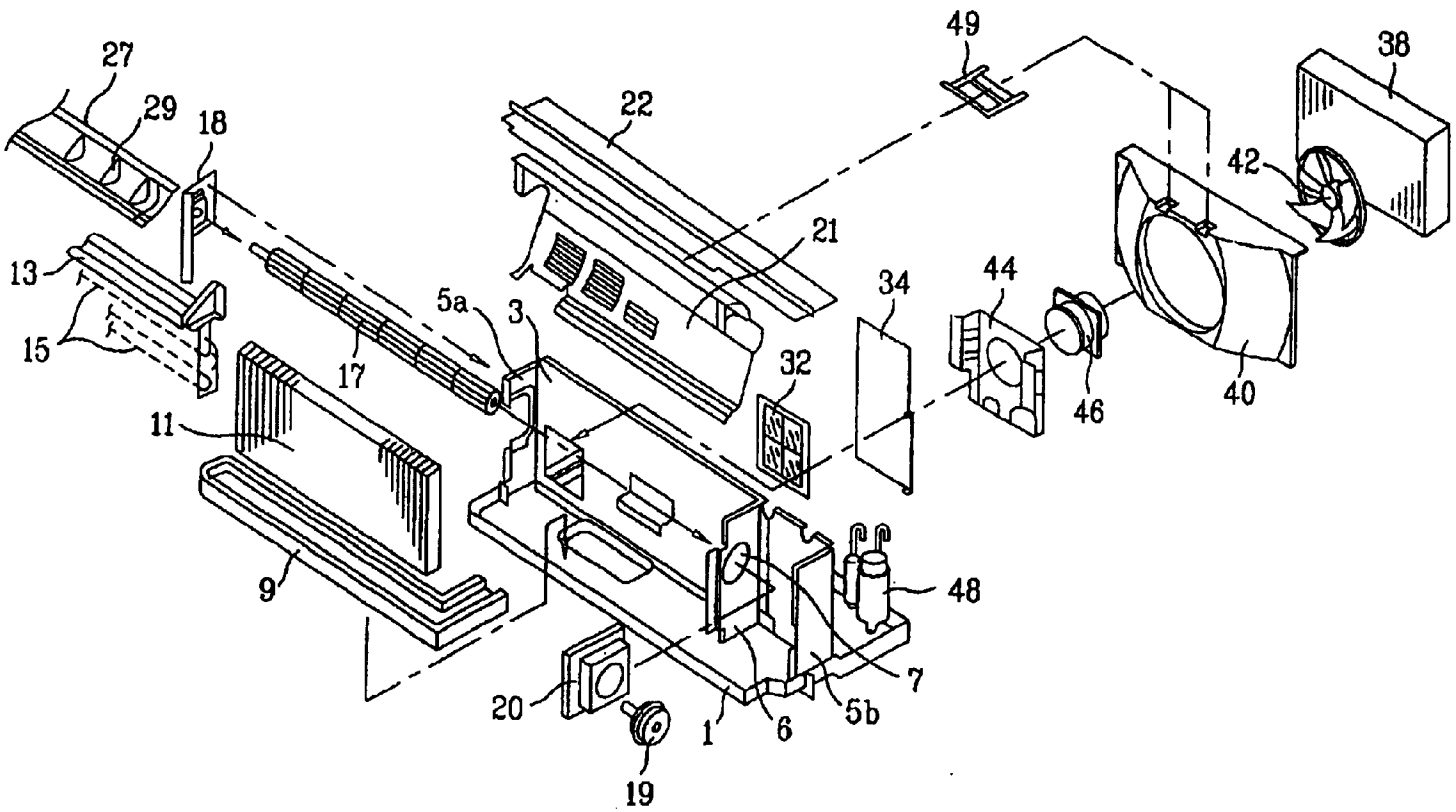
FIG. 1 illustrates a disassembled perspective view of a related art unit type air conditioner.
Figure 2:
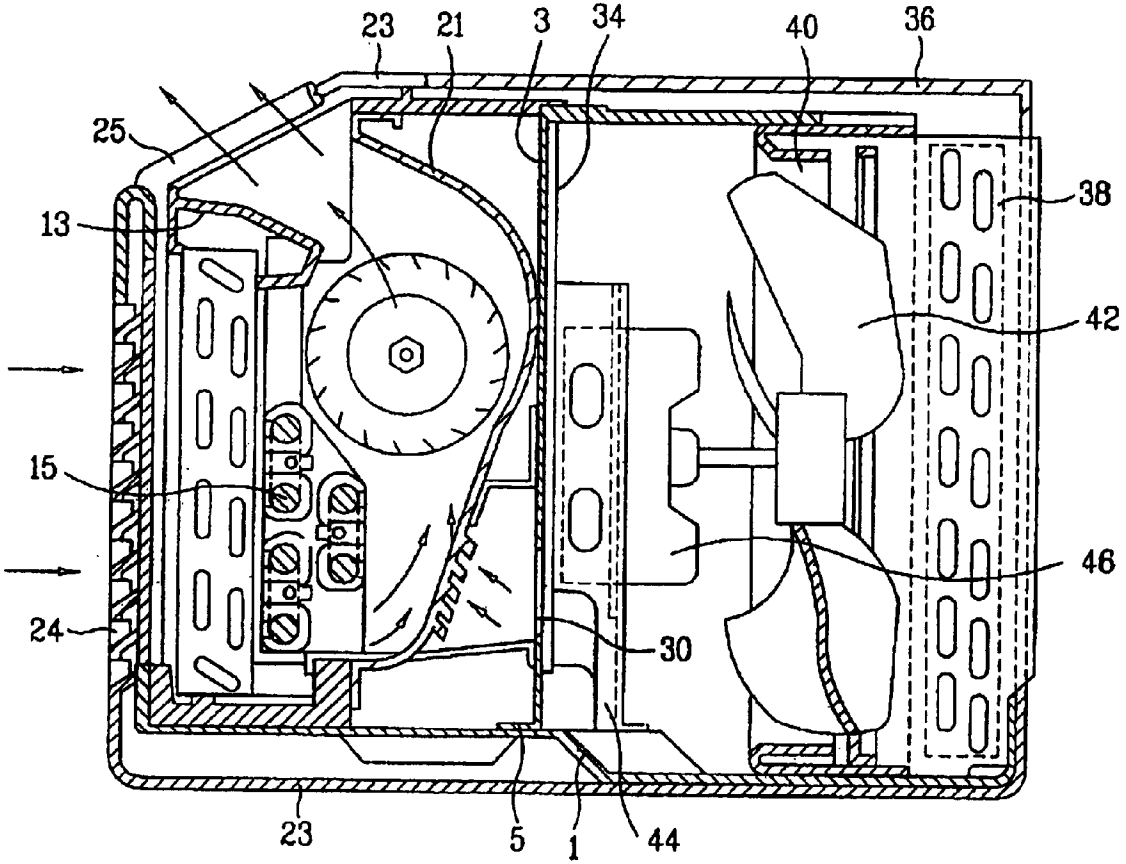
FIG. 2 illustrates a section of a related art unit type air conditioner.
Figure 3:
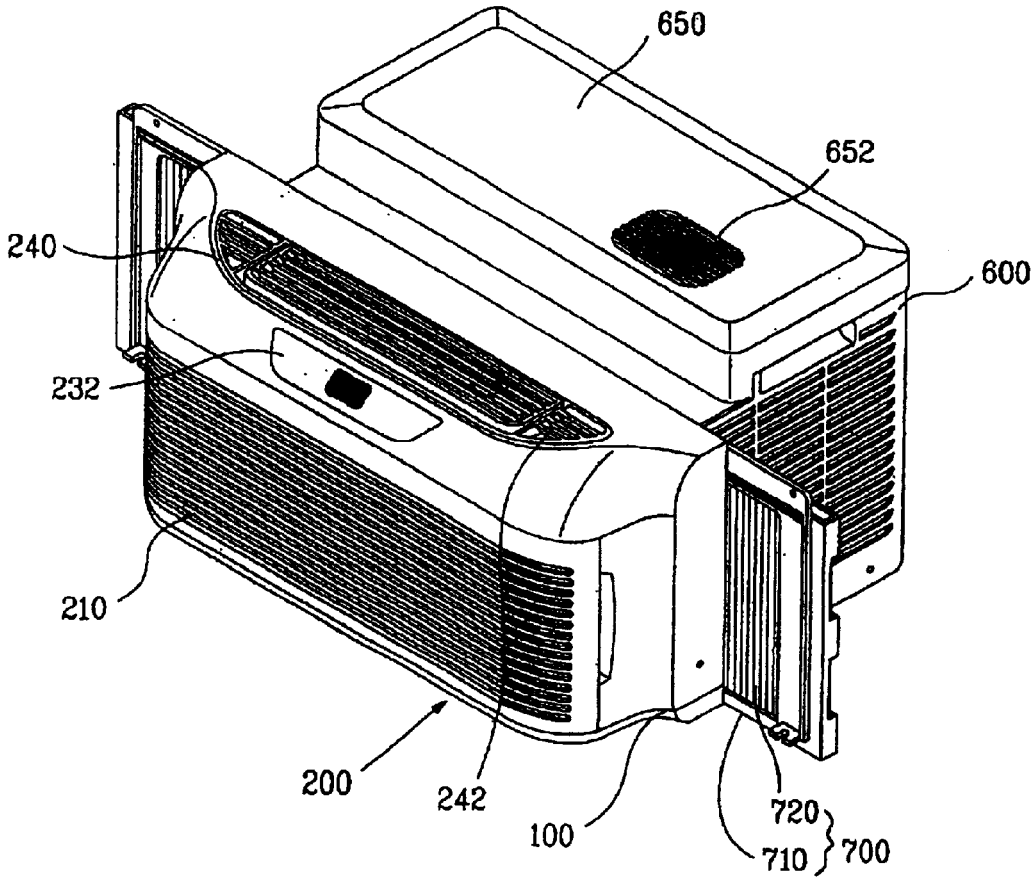
FIGS. 3 and 4 illustrate disassembled perspective views each showing a unit type air conditioner in accordance with a preferred embodiment of the present invention.
Figure 4:
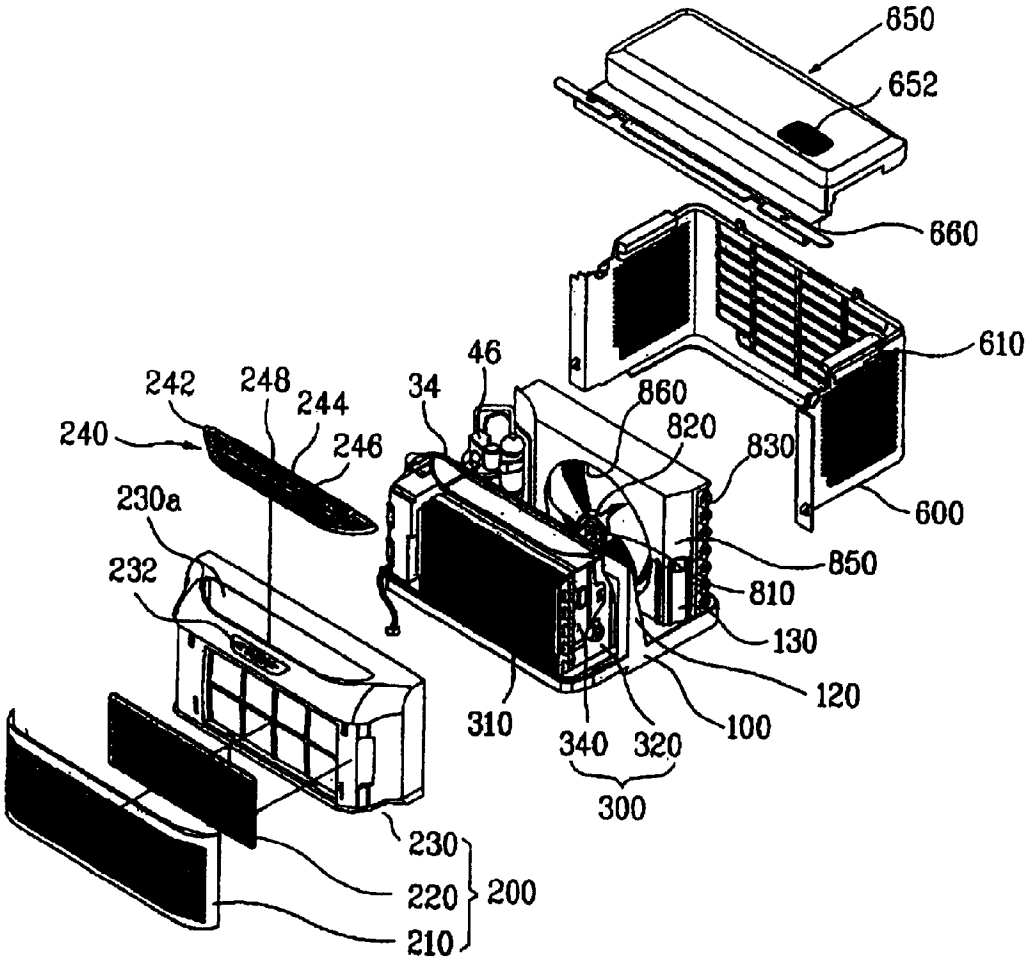

Reference will now be made in detail to the preferred embodiments of the present invention, examples of which are illustrated in the accompanying drawings. In describing the embodiments, identical parts will be given the same names and reference symbols, and repetitive description of which will be omitted. FIGS. 3 and 4 illustrate disassembled perspective views each showing a unit type air conditioner in accordance with a preferred embodiment of the present invention.

Referring to FIGS. 3 and 4, the unit type air conditioner has a base plate 100 in a bottom part thereof. The base plate 100, substantially rectangular, has a barrier 120 projected upward from a center part thereof. The barrier 120 divides the unit type air conditioner into a room part and an outdoor part.

There is a front panel 200 in a front part of the air conditioner to form a front exterior of the air conditioner. The front panel 200 is formed of a plastic, and includes a front frame 230, a suction grill 210, and an air filter 220.

The suction grill 210, fitted to the front frame 230, passes the air drawn into the air conditioner, and the air filter 220, fitted to a rear surface of the suction grill 210, cleans the drawing air.

The front frame 230 has a discharge opening 230*a* in an upper part thereof, with a discharge frame 240 mounted thereon for passing air discharged from an inside of the air conditioner. There are discharge grill part 242 at opposite side part thereof formed as one unit with the discharge frame 240, and detachable discharge grill 244 mounted on a central part of the discharge frame 240. The discharge grill 244 has a plurality of horizontal bars 248 for controlling a direction of discharged air, and there are controllable vertical ribs 246 under the horizontal bars for guiding air flow. Reference symbol 232 denotes a display part.

The air conditioner has a cabinet 600, forming both sides and a rear side thereof. The cabinet 600 has a plurality of openings for inlet and outlet of air, and is fitted to the base plate 100 and the front frame 230.

There is a cover 650 on the cabinet 600 to form an upper exterior of the outdoor part. The cover 650 has one end with a cover ledge 660 joined with the front frame 230, and an upper part with a cover grill 652 for introduction of the outdoor air.

An inside structure of the unit type air conditioner divided with the barrier 120 into the indoor part and the outdoor part will be described.

In the indoor part, there is an indoor heat exchanger 310. The indoor heat exchanger 310 makes the air drawn from the room to heat exchange with the working fluid in the heat exchange cycle. The indoor heat exchanger 310 has an air guide 300 with an upper air guide 340 and a lower air guide 320 fitted thereto, and there is an indoor fan 410 (see FIG. 14) in the air guide 300.

There is a discharge guide 250 on the air guide 300 for guiding the air passed through the air guide 300 to the discharge openings 230*a*. The discharge guide 250 is in communication with the discharge frame 240.

Next, in the outdoor part, an outdoor motor 810 is provided for driving the outdoor fan 820. The outdoor motor 810 has a rotation shaft extended in opposite directions, one of which passes through the barrier 120 and extended up to an inside of the air guide 300.

Also, in the outdoor part, there is a shroud for guiding air flow formed by the outdoor fan 820. The shroud has a lower shroud 130 and an upper shroud 850, and a central opening 860 for mounting the outdoor fan 820 therein.

The shroud is fitted to the outdoor heat exchanger 830. The outdoor heat exchanger 830 makes the outdoor air drawn by the outdoor fan 820 to heat exchange with the working fluid in the heat exchange cycle. The reference symbol 840 in the drawing denotes a compressor.

In the meantime, for installation of the unit type air conditioner, for blocking gap between the air conditioner and a window, or the like, a curtain assembly is used. The curtain assembly 700 has a curtain frame 710 and a curtain 720, wherein the curtain frame 710 is joined with the cover ledge 660. The reference numeral 500 denotes a control box for controlling operation of the air conditioner.

Figure 5:
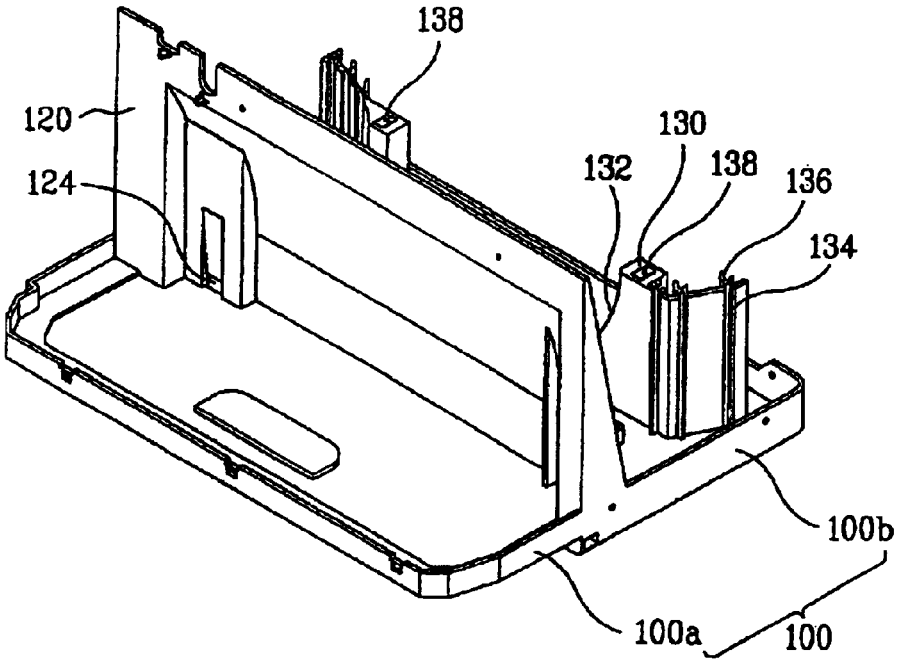
FIGS. 5 and 6 illustrate perspective views each showing a base plate in accordance with a preferred embodiment of the present invention.
Figure 6:
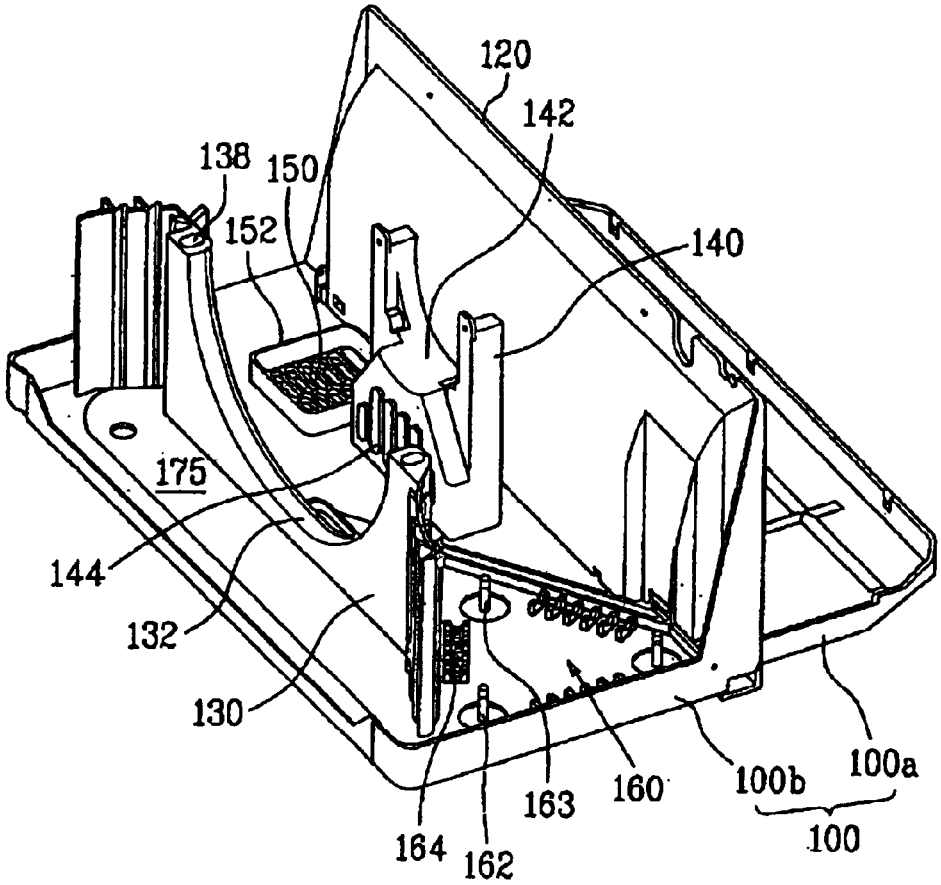

The unit type air conditioner will be described in more detail in light of components and joining therebetween, with reference to the attached drawings. FIGS. 5 and 6 illustrate perspective views each showing a base plate in accordance with a preferred embodiment of the present invention.

Referring to FIGS. 5 and 6, the base plate 100 is divided into an indoor side base 100*a,* and an outdoor side base 100*b* with reference to the barrier 120 extended in a lateral direction. The indoor side base 100*a,* positioned on a room side when the air conditioner is installed in the window or the like of a building, forms a bottom of an indoor part, and the outdoor side base 100*b* form a bottom of an outdoor part. The barrier 120 has a drain hole 124 for guiding condensed water from the indoor heat exchanger 310 to the outdoor part. The outdoor side base 100*b* has the lower shroud 130 formed as one unit thereon. The lower shroud 130 has vertical reinforcing ribs 134 at opposite ends thereof for reinforcing the lower shroud 130, each having an inversed triangular seat 136 on a top of the reinforcing rib 134. The lower shroud has a semi-circular part 132 in a central part thereof, with a hole 138 in each of opposite ends.

In the meantime, referring to FIG. 6, there is a motor mounting part 140 between the lower shroud 130 and the barrier 120. The motor mounting part 140 has a semi-circular saddle 142 for seating the outdoor motor 810 thereon.

The motor mounting part 140 has a space (not shown) formed therein in communication with an outside of the air conditioner through the bottom thereof. The motor mounting part 140 has a plurality of slots 144 opened opposite to the lower shroud 130. Therefore, the outdoor air is drawn into an inside of the air conditioner from below the base plate 100 through the slots 144.

There is a lower grill 150 on one side of the motor mounting part 140 opened to the outside of the air conditioner, around which a guide plate is provided for guiding air drawn from below the base plate 100.

There is a compressor mounting part 160 on the outdoor side base 100*b*. The compressor mounting part 160 has three fastening projections 162 at three apexes of a regular triangle. It is preferable that the fastening projections 162, in general formed of metal, are provided at the time of injection molding of the outdoor side base 100*b*. Of course, a number and forms of the fastening projections 162 may be varied, and may be formed as one unit with the base plate 100. There is a circular seat 163 around each of the fastening projections 162. The seat 163 is provided with a damping device (not shown) fitted to a bottom of the compressor 840 for protecting the compressor 840 from vibration. There are a group of saddle like tips 164 projected upward from the outdoor side base 100*b* between the fastening projections 162, to be fitted to a bottom of the compressor 840.

Figure 7:
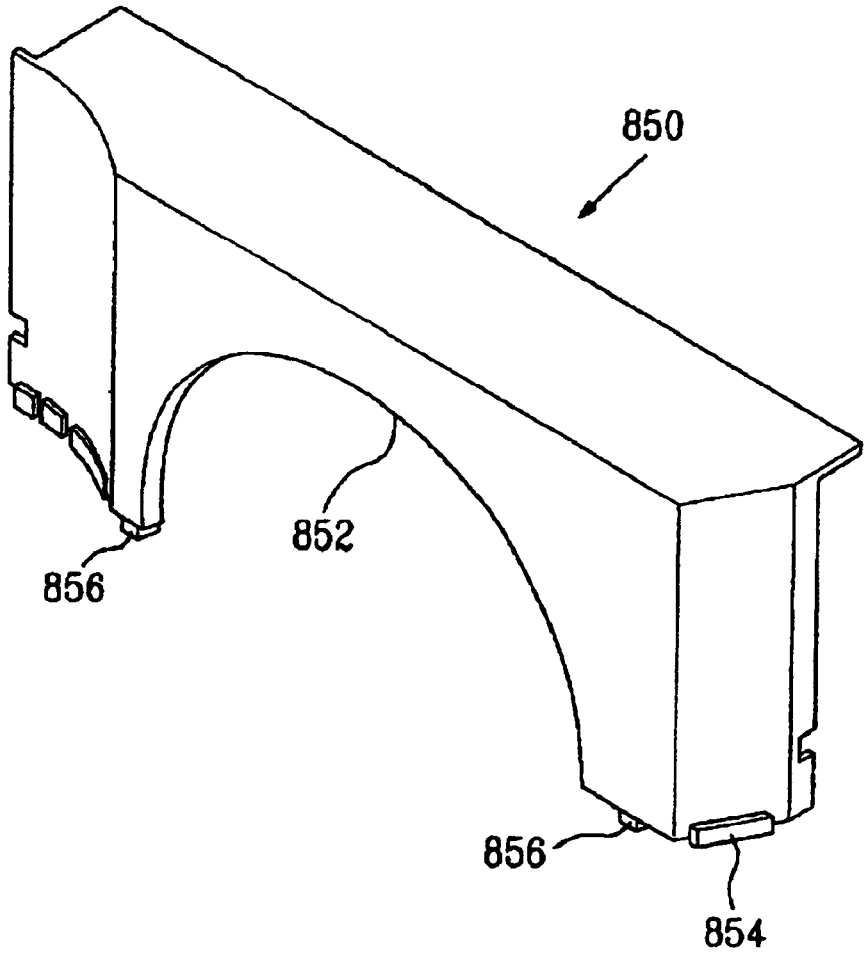
FIG. 7 illustrates a perspective view of an upper shroud in accordance with a preferred embodiment of the present invention.

In the meantime, the upper shroud 850 in on the lower shroud 130 fitted thereto. FIG. 7 illustrates a perspective view of an upper shroud in accordance with a preferred embodiment of the present invention.

Referring to FIG. 7, the upper shroud 850 has a semi-circular part 852 opposite to the semi-circular part 132 of the lower shroud 130. The upper shroud 850 also has a stepped part 854 on a side, and tips 856 to be inserted in the holes 138. The stepped part 854 is seated on a side surface of the lower shroud 130 for rigid fastening of the upper and lower shrouds 130 and 850. The tips 856 are inserted in the holes 138, for joining the upper and lower shrouds 130 and 850. When the upper shroud 850 joins with the lower shroud 130, the semi-circular parts 132 and 852 of the upper and lower shrouds 130 and 850 form the opening 860 in communication with a side of the outdoor heat exchanger 830. As described before, the outdoor fan 820 is mounted in the opening 860, connected to the outdoor motor 810 mounted on the motor mounting part 140.

Figure 8:
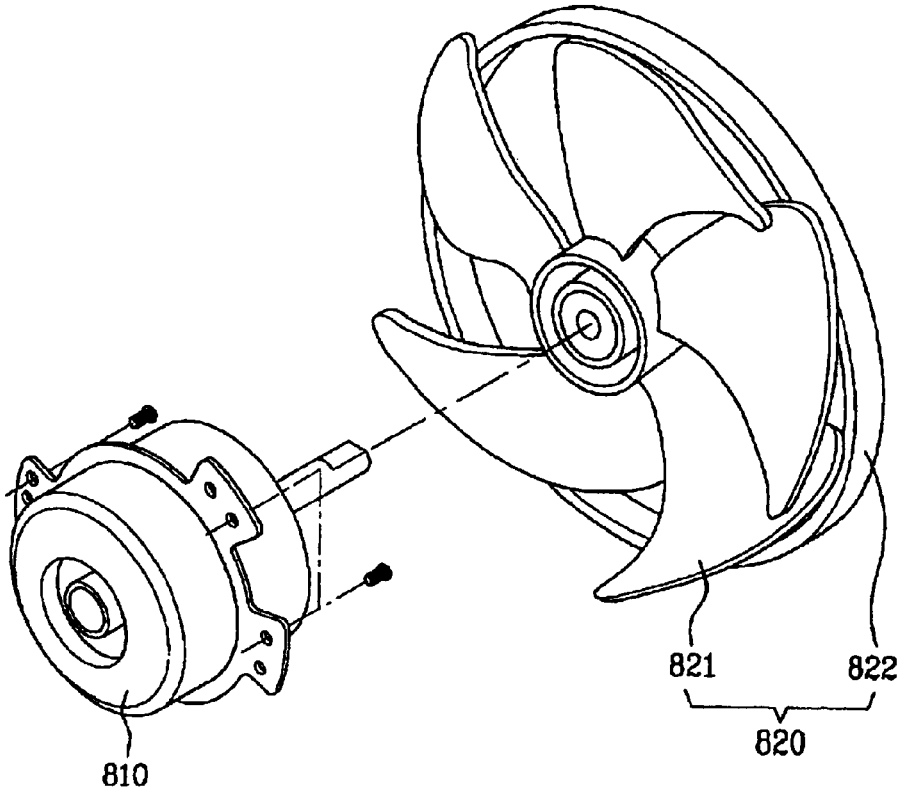
FIG. 8 illustrates a perspective view of a fastening structure of an outdoor motor and an outdoor fan.

FIG. 8 illustrates a perspective view of a fastening structure of an outdoor motor and an outdoor fan.

Referring to FIG. 8, the outdoor fan 820 has a plurality of blades 821 and a fan slinger 822 connected between ends of the blades 821. The fan slinger 822, rotated with a shaft of the outdoor motor 810, sprays condensed water introduced into the outdoor side base 100*b* through the drain hole 124 in the barrier 120 in cooling to the outdoor heat exchanger 830 in rear of the outdoor fan 822. Thus, the fan slinger 822 drops a temperature of the outdoor heat exchanger 830, to improve a cooling efficiency.

In the meantime, the air guide 300 having the upper air guide 340 and the lower air guide 320 is on the indoor side base 100*a*. The air guide 300 guides the air drawn by the indoor fan 410 (see FIG. 14), and holds the indoor motor 420 (see FIG. 10) connected to the indoor fan 410, and a bearing assembly 440 (see FIG. 10) to be described later.

Figure 9A:
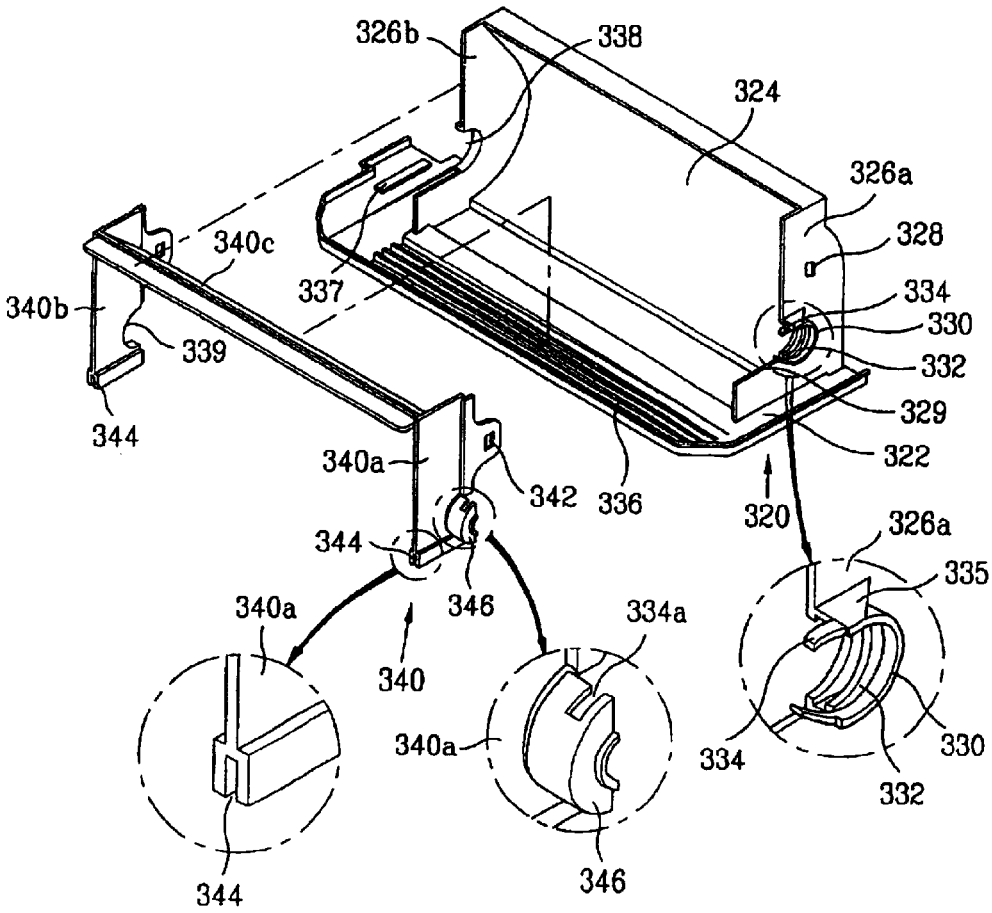
FIGS. 9A and 9B illustrate disassembled perspective views each showing an air guide in accordance with a preferred embodiment of the present invention.
Figure 9B:
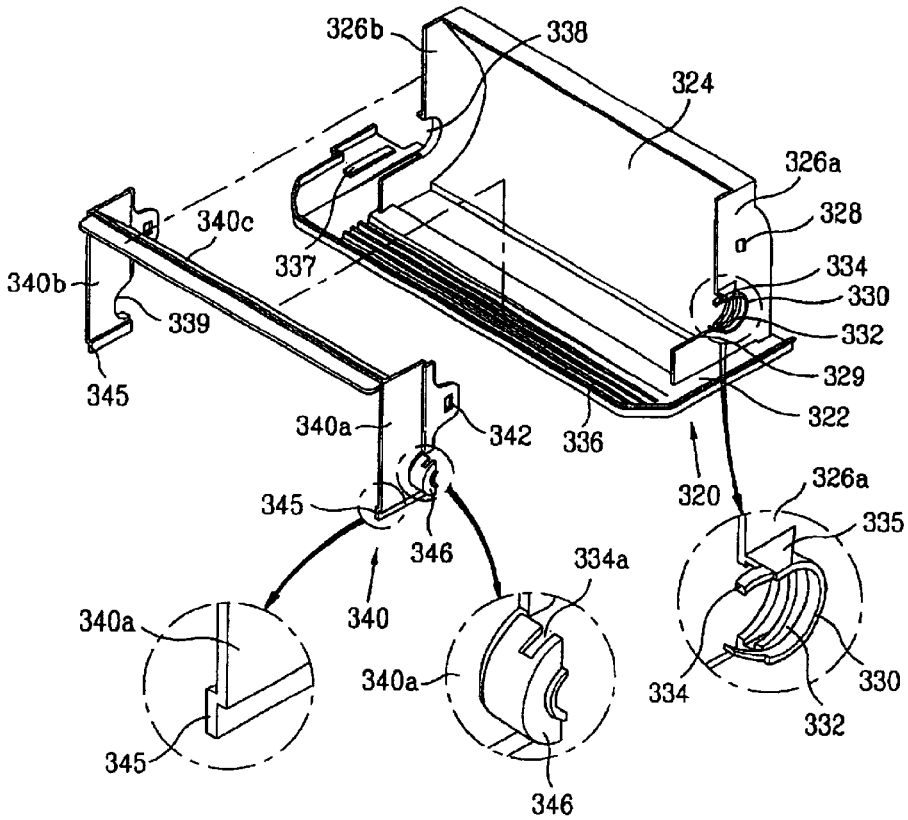

FIGS. 9A and 9B illustrate disassembled perspective views each showing an air guide in accordance with a preferred embodiment of the present invention.

Referring to FIG. 9A, the lower air guide 320 has a base 322 forming a bottom thereof, a rear wall part 324, and first and second sidewall parts 326*a* and 326*b*. The base 322 has channels 336. The channels 336 are formed for draining the condensed water from the indoor heat exchanger 310 over the base. The rear wall part 324, having a round inside surface, is joined with the barrier 120 when the lower air guide 320 is mounted on the indoor side base 100*a*. There are tips 328 on upper parts of the first and second sidewall parts 326*a* and 326*b* respectively, for fastening the lower air guide 320 to the upper air guide 340, and there is a semi-circular first supporting part 330 in the first sidewall part 326*a*. The first supporting part 330 has a width of semi-circular projection 332 from an inside, and the semi-circular projection 332 has a circumferential extension 334.

There is a flat surface on the top of the first supporting part 330 for reinforcing the first supporting part 330. The flat surface 335 may be formed on an under side of the first supporting part 330, additionally.

Each of the first, and second sidewall parts 326*a,* and 326*b* has a guide part 329 in a lower part. The guide part 329 slidably receives a channel part 344 in the upper air guide 340, and seals air leakage.

Moreover, there are a semi-circular first motor supporting part 338 for supporting the indoor motor 420 in the second sidewall part 326*b* of the lower air guide 320, and a positioning plate 337 on one side of the second sidewall part 326*b* for mounting the indoor motor 420 thereon.

In the meantime, the upper air guide 340 has third and fourth sidewall parts 340*a* and 340*b,* and a guide surface 340*c* formed, and connected between upper parts of the third and fourth sidewall parts 340*a* and 340*b.* The guide surface, with a slope, guides an air flow formed by the indoor fan 410 in an upper direction.

The third, and fourth sidewall parts 340*a,* and 340*b* have fastening holes 342 engaged with the tips 328 on the first and second sidewall parts 326*a* and 326*b* respectively, and the fourth sidewall part 340*b* has a second motor supporting part 339 to be engaged with the first motor supporting part 338 in the second sidewall part 326*b.*

There is a second supporting part 346 in a lower part of the third sidewall part 340*a.* The second supporting part 346 is engaged with the first supporting part 330, and has a circular slot 334*a* engaged with the circumferential extension 334 from the first supporting part 330. There may be flat surfaces 335 on an upper part and/or lower part of the second supporting part 346 identical to the flat surfaces at the first supporting part 330.

In the meantime, there are channel parts 344 in bottoms of the third and fourth sidewall parts 340*a* and 340*b.* As described before, the channel parts 344 are slidably engaged with the guide parts 329 in the sidewall parts 326*a,* and 326*b* in the lower air guide 320.

Of course, there may be a variety of variations of the channel part 344. For an example, as shown in FIG. 9, inwardly bent stepped parts 345 may be formed at opposite sides of lower parts of the upper air guide 340 instead of the channel part 344.

The indoor fan 410 is mounted in the air guide 300.

Figure 10:
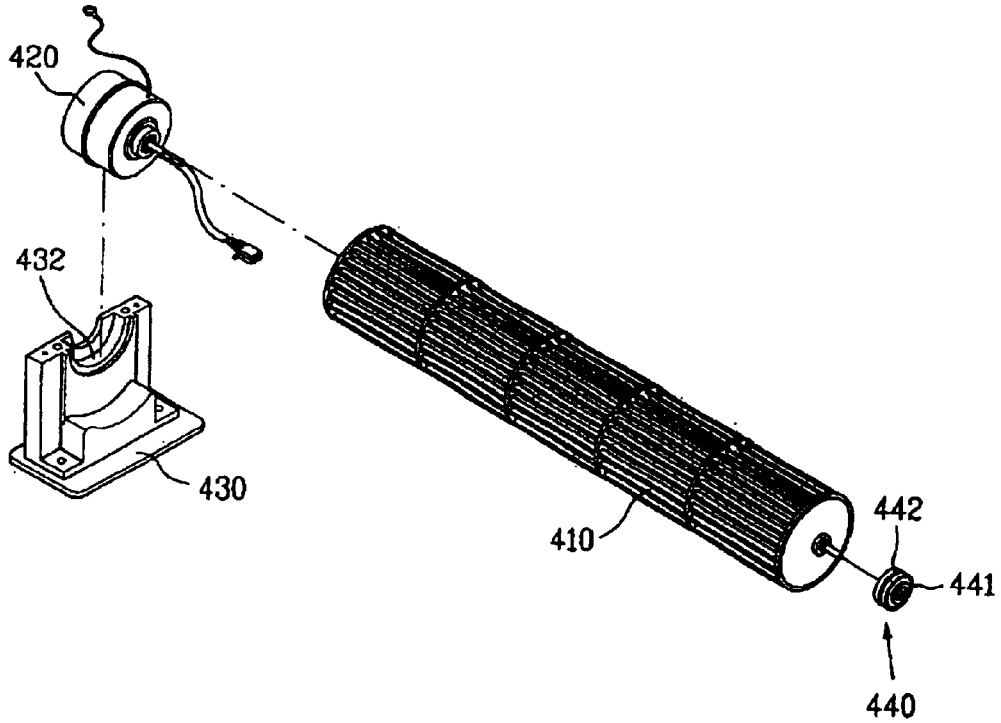
FIG. 10 illustrates a perspective view of a fastening structure of an indoor fan in accordance with a preferred embodiment of the present invention.

FIG. 10 illustrates a perspective view of a fastening structure of an indoor fan in accordance with a preferred embodiment of the present invention.

Referring to FIG. 10, a sirocco fan is employed as the indoor fan 410 for directing air drawn therein in a radial direction, and has a bearing assembly 440 on one side thereof.

The bearing assembly 440 has a bearing (not shown) therein, and a bearing cover 441 surrounding the bearing. The bearing cover 441, in general formed of rubber, has an insertion groove in an outside circumference. The insertion groove 442 is engaged with semi-circular projection 332 on the first supporting part 330.

The indoor fan 410 has the indoor motor 420 on the other side for providing power to the indoor fan 410. The indoor motor 420 is mounted on the indoor motor mounting part 430 having a semi-circular mounting surface 432.

Figure 11:
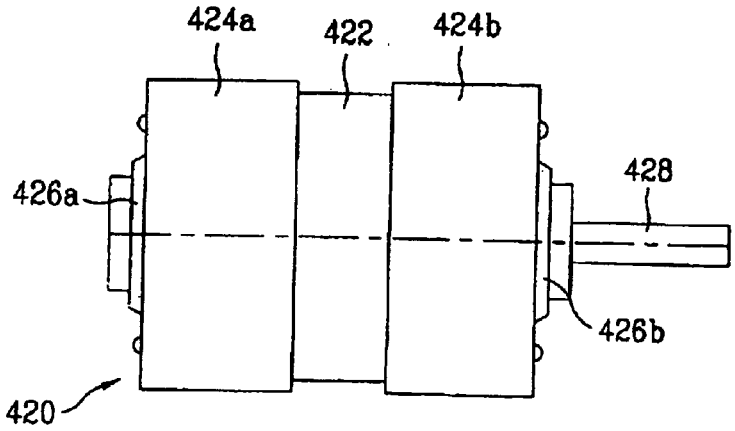
FIG. 11 illustrates a section showing the indoor motor in FIG. 10 in more detail.
Figure 12:
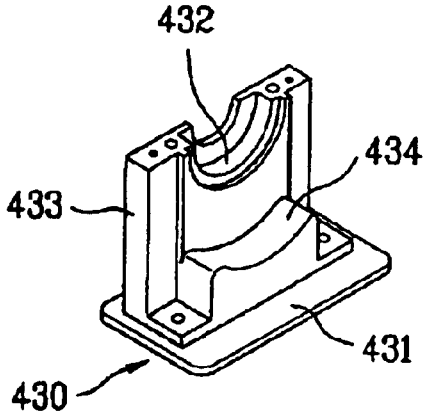
FIG. 12 illustrates a perspective view showing an indoor motor mounting part in FIG. 10.
Figure 13:
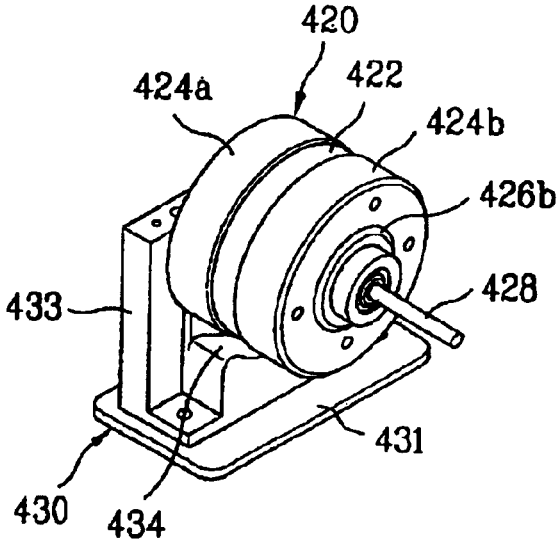
FIG. 13 illustrates a perspective view showing a state an indoor motor is mounted on an indoor motor mounting part in accordance with a preferred embodiment of the present invention.

FIG. 11 illustrates a section showing the indoor motor in FIG. 10 in more detail, FIG. 12 illustrates a perspective view showing an indoor motor mounting part in FIG. 10, and FIG. 13 illustrates a perspective view showing a state an indoor motor is mounted on an indoor motor mounting part in accordance with a preferred embodiment of the present invention.

The indoor motor 420 will be discussed in more detail.

Referring to FIG. 11, the indoor motor 420 has a rotation shaft 428, a motor body 422, and first, and second covers 424*a* and 424*b* in opposite side parts of the motor body 422. There are first and second cover supplementary parts 426*a* and 426*b* at sides of the first, and second covers 424*a* and 424*b,* respectively. The first cover supplementary part 426*a* is seated on the mounting surface 432 in the indoor motor mounting part 430, and the second cover supplementary part 426*b* is held with the first and second motor supporting part 338 and 339 in the upper and lower air guides 320 and 340. The rotation shaft 428 of the indoor motor 420 is connected to the indoor fan 410.

Referring to FIG. 12, the indoor motor mounting part 430 has a bottom plate 431, a pedestal 433 on the bottom plate 431, the mounting surface 432 in an upper central part of the pedestal 433 for seating the first cover supplementary part 426*a,* and a cover seating part 434 at one side of the pedestal 433. The cover seating part 434 has a form fit to an outside circumferential surface of the first cover 424*a.* It is preferable that the indoor motor mounting part 430 is formed of plastic.

Moreover, referring to FIG. 13, the indoor motor 420 is mounted on the indoor motor mounting part 430.

Figure 14:
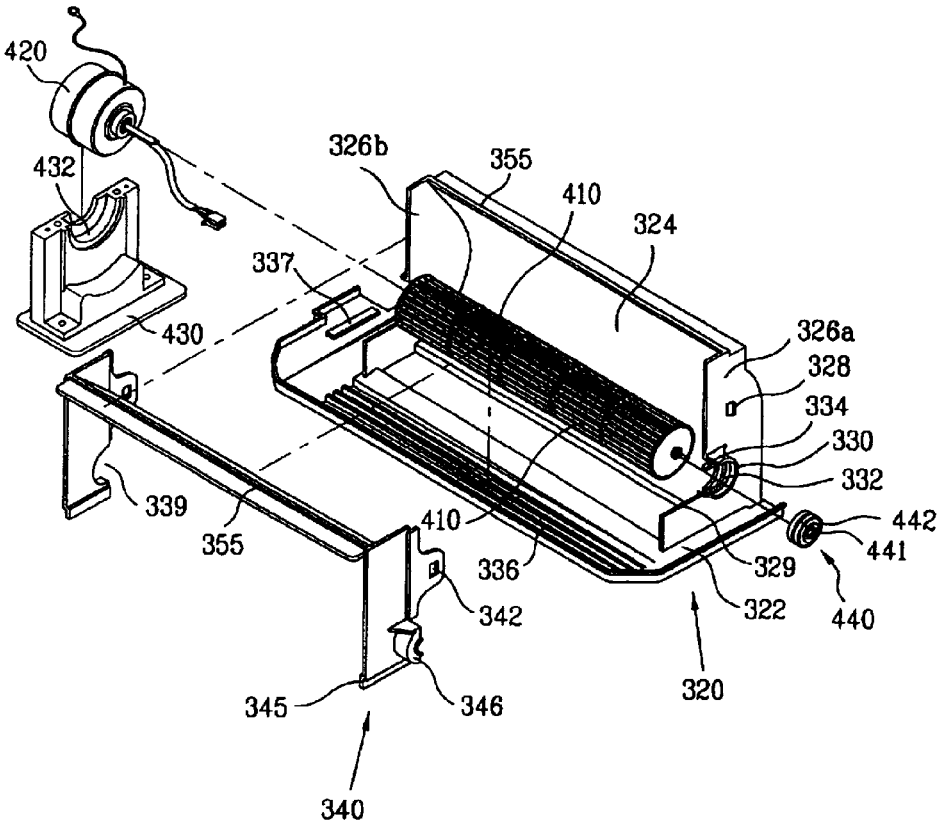
FIG. 14 illustrates a disassembled perspective view showing a fastening structure of an indoor fan and upper/lower air guides in accordance with a preferred embodiment of the present invention.

FIG. 14 illustrates a disassembled perspective view showing a fastening structure of an indoor fan and upper/lower air guides in accordance with a preferred embodiment of the present invention.

Referring to FIG. 14, as described before, the indoor fan 410, connected to the indoor motor 420 and the bearing assembly 440, is held in the upper and lower air guide 320 and 340.

In more detail, after mounting the bearing assembly 440 in the semi-circular projection of the first supporting part 330, the stepped parts 345 of the upper air guide 340 are pushed in the guide part 329 of the lower air guide 320. According to this, the first supporting part 330 and the second supporting part 346 surround the bearing assembly 440, and the projections 328 from the lower air guide 320 are engaged with the fastening holes 342 in the upper air guide 340. In this instance, the indoor motor mounting part 430 is engaged with the positioning plate 337 on the base 322 of the lower air guide 320. At the same time with this, the indoor motor 320 is held at the first and second motor supporting parts 338 and 339 in the upper and lower air guides 320 and 340.

Of course, the indoor motor mounting part 430 may be formed as one unit with the base 322, or mounted on the indoor side base 100*a* of the base plate 100.

In the meantime, the discharge guide 250 on the upper and lower air guides 320 and 340. For this, mounting ribs 355 are formed in upper parts of the upper and lower air guide 320 and 340, respectively.

Figure 15:
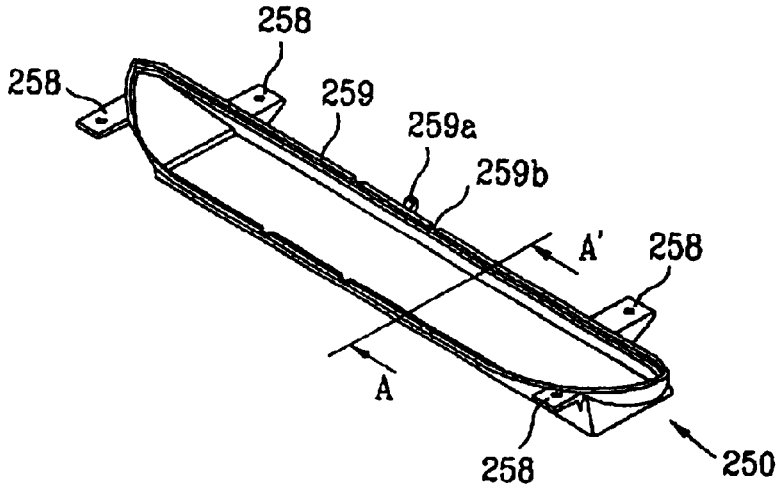
FIG. 15 illustrates a perspective view of a discharge guide in accordance with a preferred embodiment of the present invention.
Figure 16:
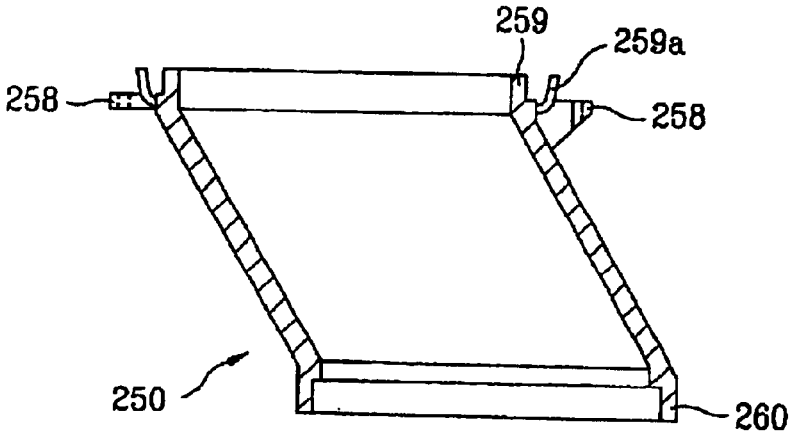
FIG. 16 illustrates a section across a line A–A' in FIG. 15.

FIG. 15 illustrates a perspective view of a discharge guide in accordance with a preferred embodiment of the present invention, and FIG. 16 illustrates a section across a line A–A' in FIG. 15.

Referring to FIG. 15, the discharge guide 250 has an upper section larger than a lower section. The discharge guide 250 has a plurality of fastening parts 258 around the upper part. The fastening parts 258 fasten the discharge guide 250 to a bottom of the discharge part 230*a* of the front frame 230. Also, there is a first rim 259 around a top of the discharge guide 250 for easy engagement with the discharge frame 240, and preventing leakage of air. There are fastening hooks 259*a* at a side of the first rim 259, and mounting slots 259*b* in the first rim 259. The mounting slots 259*b* are engaged with a mounting projection (not shown) in a bottom of the discharge frame 240.

The discharge guide 250 is arranged to be in communication with the discharge frame 240. Accordingly, the air guided by the discharge guide 250 is discharged through the discharge grill 244 and the discharge grill part 242 of the discharge frame 240.

Referring to FIG. 16, there is a second rim 260 around the bottom of the discharge guide 250 for engagement with the air guide 300. The second rim 260 is formed by cutting a thickness of a lower part of the discharge guide 250.

Figure 17:
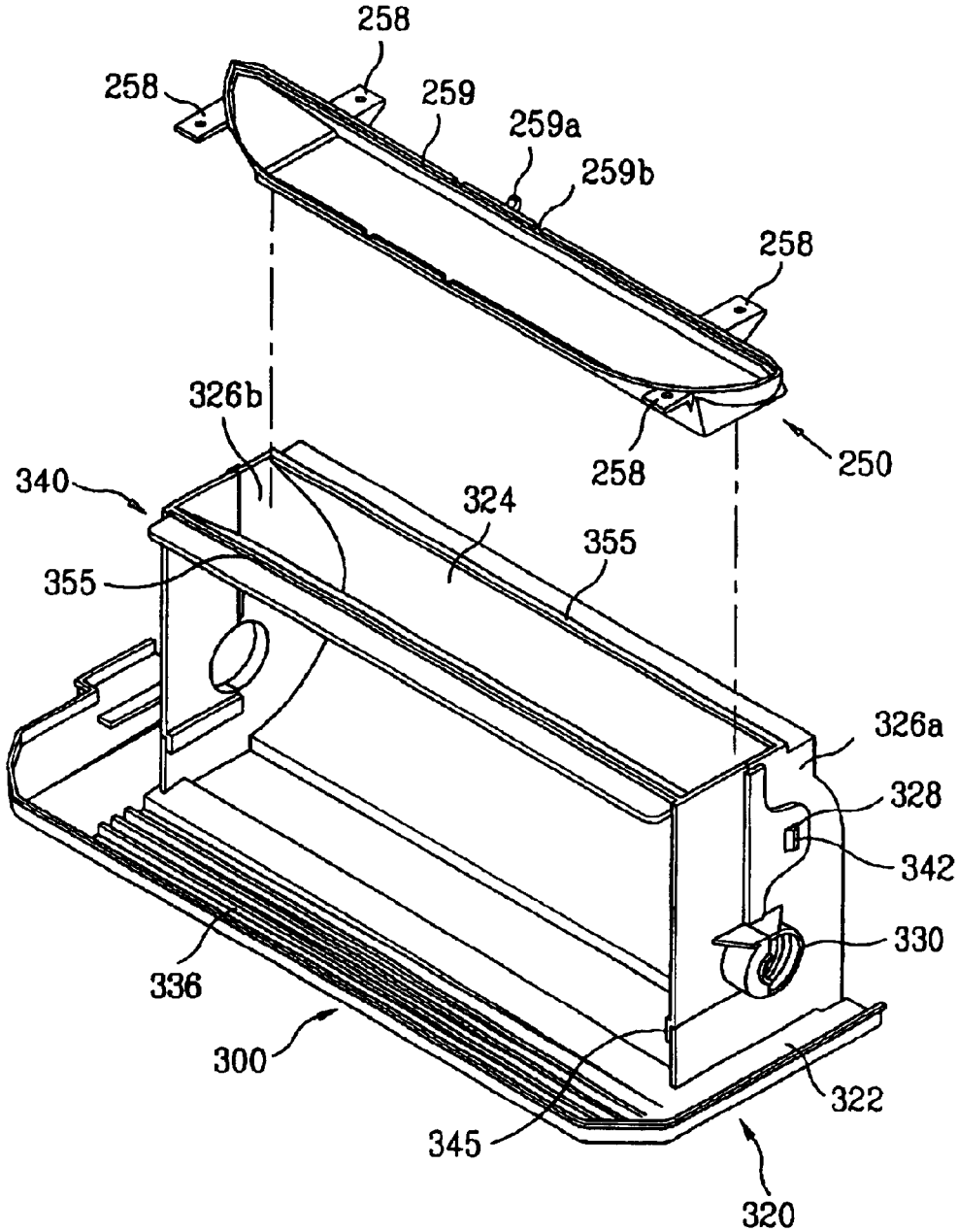
FIG. 17 illustrates a perspective view showing a discharge guide and an air guide being connected in accordance with a preferred embodiment of the present invention.

FIG. 17 illustrates a perspective view showing a discharge guide and an air guide being connected in accordance with a preferred embodiment of the present invention.

Referring to FIG. 17, the fastening between the upper and lower air guides 320 and 340 and the discharge guide 250 is made with the second rim 260 and the mounting ribs 355. The mounting ribs 335 are formed in upper parts of the upper, and lower air guides 320 and 340.

Thus, the upper part of the discharge guide 250 is fastened to the front frame 230 and the discharge frame 240, and the lower part of the discharge guide 250 is fastened to the air guide 300. According to this, the discharge guide 240 guides air from the indoor fan 410 inside of the air guide 300 toward the discharge frame 240.

Figure 18:
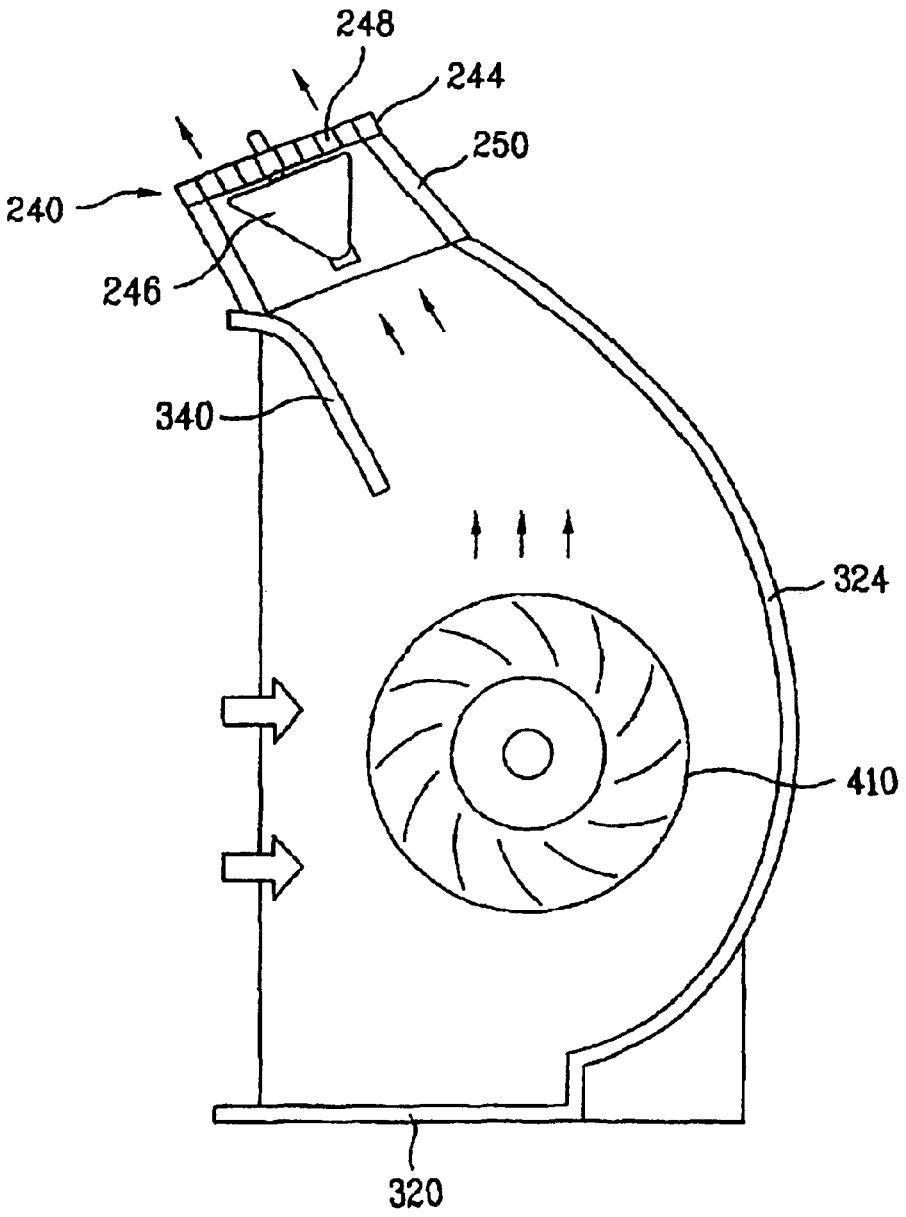
FIG. 18 illustrates a section showing a state of an indoor side air flow in a unit type air conditioner in accordance with a preferred embodiment of the present invention.

FIG. 18 illustrates a section showing a state of an indoor side air flow in a unit type air conditioner in accordance with a preferred embodiment of the present invention.

Referring to FIG. 18, the air drawn by the indoor fan 410 is guided to the discharge guide 250 by the upper and lower air guides 320 and 340. Then, the air is guided to the discharge frame 240 by the discharge guide 250. Then, the air guided by the discharge frame 240 is also discharged through the grill part 242 in opposite side parts of the discharge grill 244.

In the meantime, there is a control box 500 at a side of the air guide 300, having electric components fitted therein for controlling the air conditioner.

Figure 19:
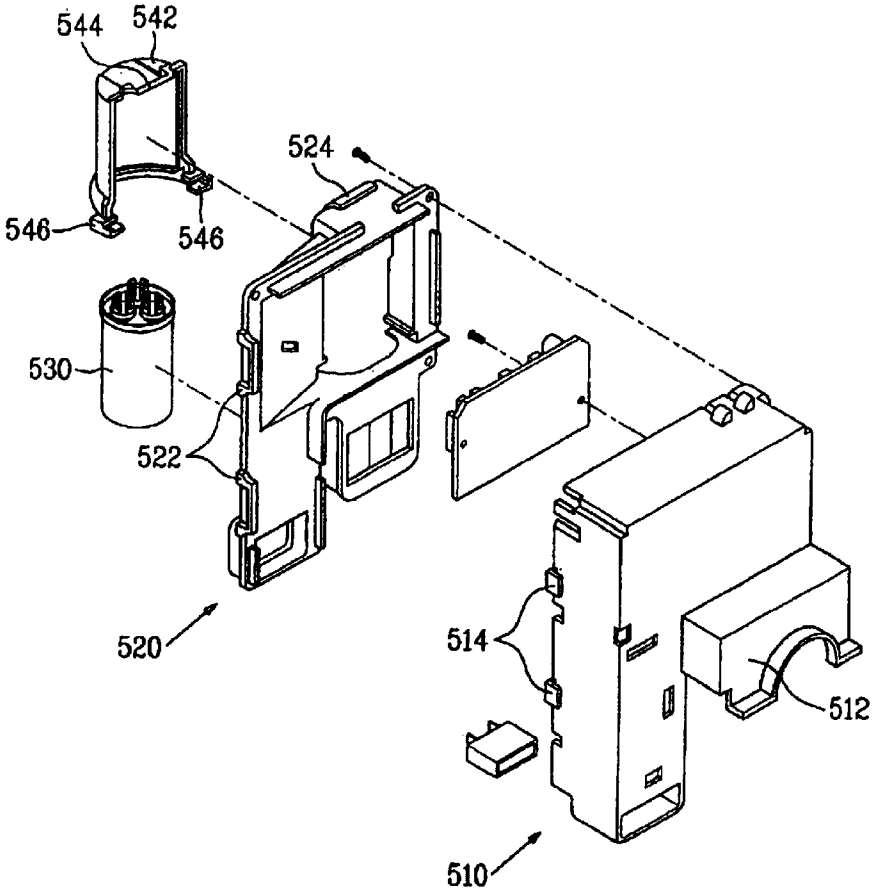
FIGS. 19 and 20 illustrate disassembled perspective views each showing a control box in accordance with a preferred embodiment of the present invention.
Figure 20:
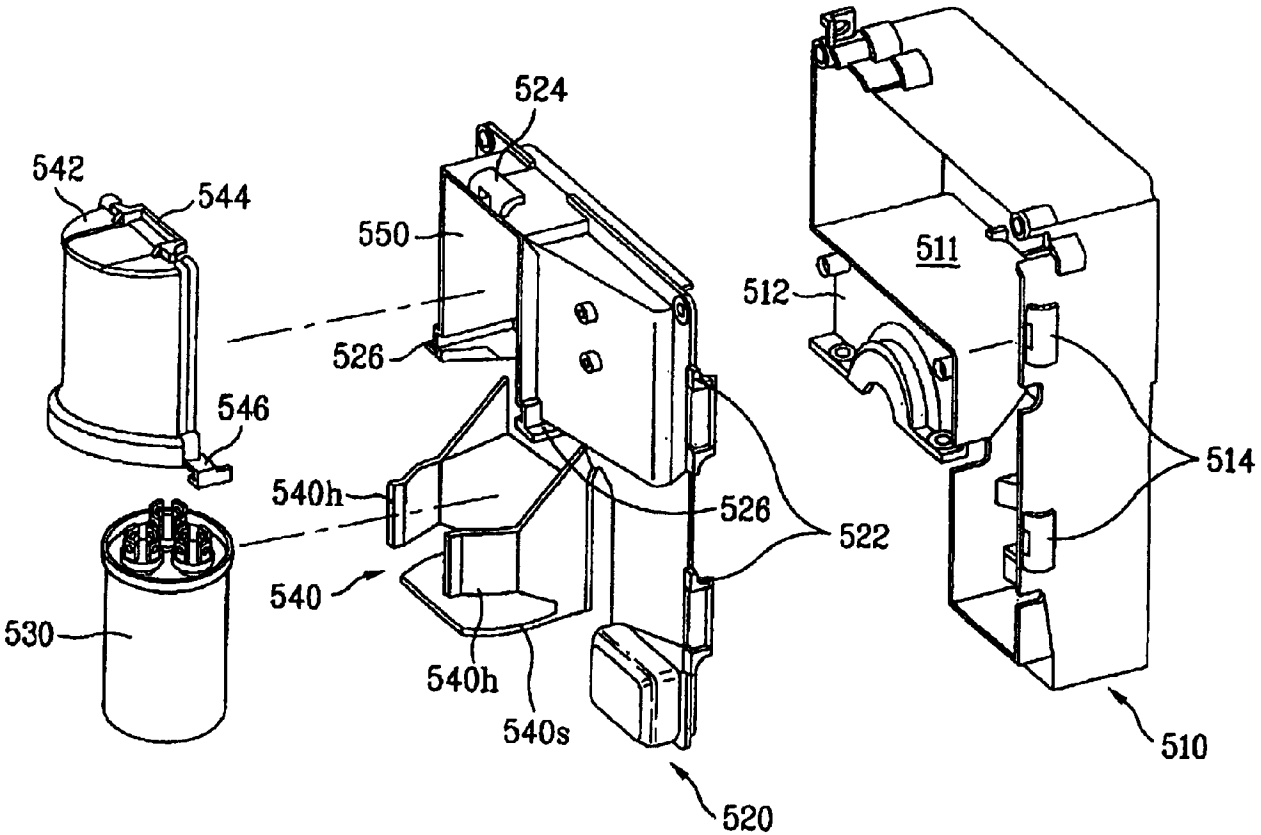

FIGS. 19 and 20 illustrate disassembled perspective views each showing a control box in accordance with a preferred embodiment of the present invention.

Referring to FIGS. 19 and 20, the control box includes a body 510 having a holding part 511 therein, and a first cover 520 fastened to the body 510. The body 510 has a motor cover 512 for holding the indoor motor 420, and first hooks 514 for fastening with the first cover 520.

The first cover 520 has first fastening slots 522, for fastening with the first hooks 514. According to this, the first cover 520 rotates around a part the slots 522 are formed therein as an axis in closing the holding part 511 of the body 510. The cover 520 may be fastened to the body 510 with screws more rigidly. The cover 520 has a first holding part 540 for holding the capacitor 530 therein.

The first holding part has a base plate 540*s* for supporting a bottom of the capacitor 530, and a holder 540*h* for surrounding an outside circumferential surface of the capacitor 530. Of course, the first holding part 540 may hold electric components other than the capacitor 530. There is a second holding part 550 over the first holding part 540 for fixing wires and the like connected to the capacitor 530. Thus, the capacitor 530 is not held in the holding part 511 in the body 510, but in the first holding part 540. That is, the capacitor 530 has a bottom supported on a base plate 540*s*, and an outside circumferential surface held in the holder 540*h*. Thus, the capacitor 530 is fitted at a position separated from the electric components fitted in the holding part 511 of the body 510. Thus, the capacitor 530 and the other electric components can avoid giving/receiving electrical/thermal influences.

In the meantime, the second holding part 550 has a second cover 542 detachably fitted thereto. The second cover 542 is semi-cylindrical, and has a second fastening slot 544. The second fastening slot 544 is fastened to a second hook 524 over the second holding part 550. There are first fastening members 526 in a lower part of the second holding part 550, and the second cover 542 has second fastening members 546 to be fastened to the first fastening members 526. According to this, the second cover 542 is fastened to the second holding part 550 with the second fastening slot 544 and the second fastening members 546. Thus, the second cover 542 closes the second holding part 550 for protecting wires and the like therein from an external impact or force.

Figure 21:
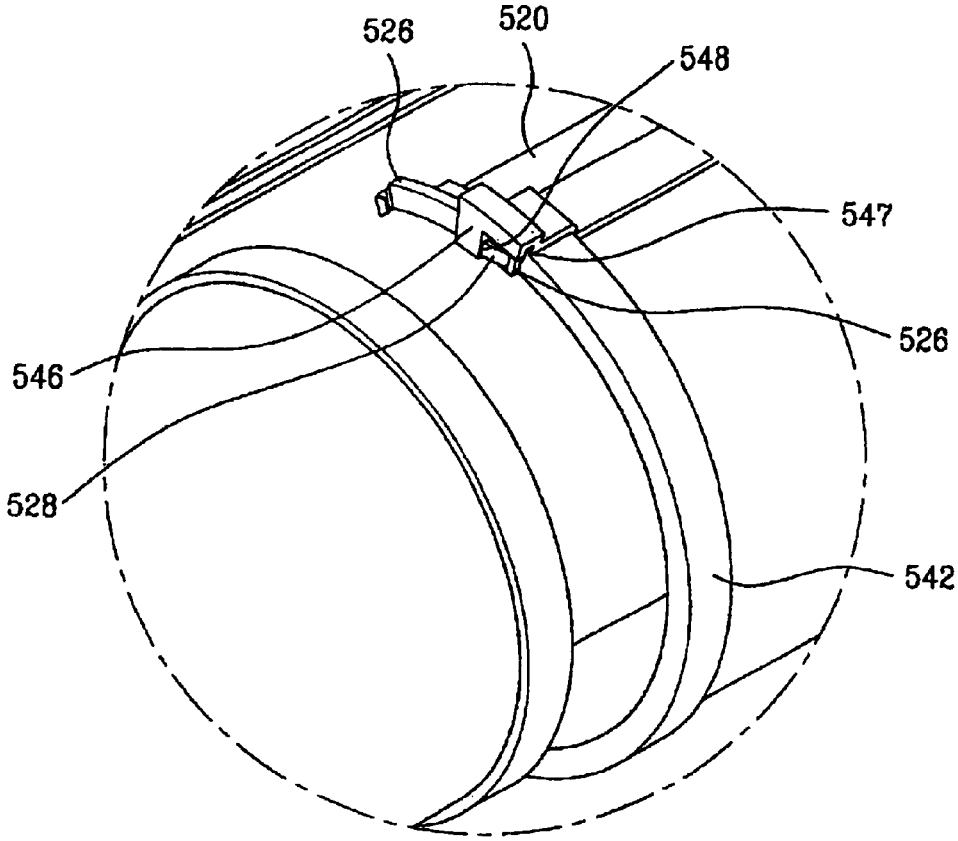
FIG. 21 illustrates a perspective view showing a fastening structure of a second receiving part and a second cover part in accordance with a preferred embodiment of the present invention.

FIG. 21 illustrates a perspective view showing a fastening structure of a second receiving part and a second cover part in accordance with a preferred embodiment of the present invention.

Referring to FIG. 21, there is a stopper 528 projected from an underside of the first fastening member 526, and the second fastening member 546 has an inserting channel 547 and a cut away part 548.

The stopper 528 with a slope is held at the cut away part 548, and the inserting channel 547 has the first fastening member 526 inserted therein. That is, when the second cover 542 rotates around the second hook 524, until the second cover 542 comes into close contact with the first cover 520, the first fastening member 526 is inserted in the inserting channel 547. Then, the second fastening member 546 deforms elastically, and moves along the slope of the stopper 528. The second fastening member 546 moves until the stopper 528 is held at the cut away part 548. Once the stopper 528 is held at the cut away part 548, the second fastening member 546 is fastened to the first fastening member 526. According to this, the second cover 542 can be fastened to the first cover 520 with the first and second fastening members 526 and 546, without any additional screws or the like. Of course, the fastening structure is merely one embodiment, and a variety of embodiments are available. For an example, the first and second covers 520 and 542 may be fastened with simple hooks or screws.

Figure 22:
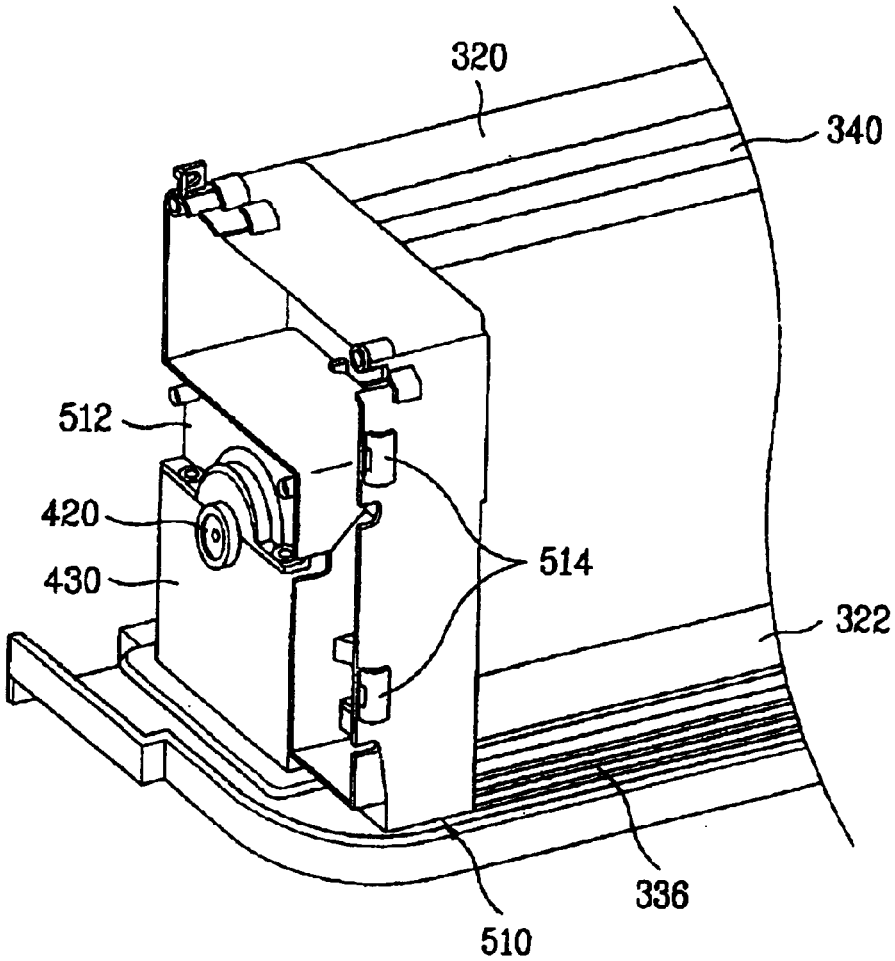
FIG. 22 illustrates a perspective view showing a state an indoor motor is mounted in a motor cover in accordance with a preferred embodiment of the present invention.

The indoor motor 420 is mounted in the motor cover 512 of the body 510. FIG. 22 illustrates a perspective view showing a state the indoor motor is mounted in the motor cover in accordance with a preferred embodiment of the present invention.

Referring to FIG. 22, the indoor motor 420 has one end held at the first and second motor supporting parts 338 and 339 of the upper and lower air guides 320 and 340, and the other end seated on the indoor motor mounting part 430 on the base 322 of the lower air guide 320. Moreover, an upper part of the other end of the indoor motor 420 is covered with the motor cover 512 of the body 510. The motor cover 512 covers the indoor motor 420, and fastened to the indoor motor mounting part 430.

The operation of the unit type air conditioner will be described.

The air conditioner of the present invention can be operated in a cooling mode or a heating mode. In this specification, cooling operation will be described, as an example.

Upon putting the air conditioner into operation, the indoor fan 410 is rotated, to draw room air through the suction grill 210 in the front panel 200. The air drawn through the suction grill 210 is cleaned at the air filter 220, heat exchanges with the working fluid in the heat exchange cycle at the indoor heat exchanger 310.

Then, the air is guided to the discharge guide 250 by the air guide 300, and discharged to the room again through the discharge grill 244 and the grill part 242 in the discharge frame 240. The air discharged thus circulates, and cools the room, and introduced into the air conditioner through the suction grill 210 again. This process is repeated continuously during the air conditioner is operated.

On the other hand, the working fluid having heat transferred at the indoor heat exchanger 310 is introduced into the outdoor heat exchanger 830, where the working fluid heat exchanges with air drawn from outside of the air conditioner, to discharge the heat to the outside of the air conditioner.

In more detail, when the outdoor fan 820 is operated by the outdoor motor 810, outdoor air is drawn into the outdoor side of the air conditioner through opening 860 in the cabinet 600. The drawn outdoor air is introduced to the outdoor fan 820 through the shrouds 130 and 850, and the barrier 120, and guided to the outdoor heat exchanger 830. Then, the outdoor air guided to the outdoor heat exchanger 830 is discharged to a rear side of the cabinet 600 after the outdoor air heat exchanges with the working fluid in the heat exchange cycle.

As has been described, the unit type air conditioner of the present invention has the following advantages.

First, the discharge guide is in communication with the discharge frame having the discharge grill and the grill parts. Therefore, the air guided by the discharge guide is discharged, not only upward, but also in both sides by the discharge grill and the grill parts. That is, the unit type air conditioner of the present invention discharges to different directions at the same time, permitting to improve an operation efficiency.

Second, the joining of the indoor fan and the air guide is made as the air guide holds the bearing assembly and the indoor motor that hold a shaft of the indoor fan. Therefore, no additional component is required for holding the indoor fan, that reduces a production process. Moreover, since the indoor motor is also held by the air guide, assembly becomes easy.

Third, the capacitor is held in the first holding part, and other electric components are fitted in the holding part inside of the body. Therefore, electrical/thermal interferences between the capacitor and the electric components can be avoided, to improve operation characteristics of the air conditioner. Moreover, spread of fire from the capacitor or the electric components to an environment can be cut off, effectively. Since the first cover is made to open the holding part in the body, maintenance of the electric components fitted to the body is easy. The holding of the indoor motor with the motor cover of the body of the control box permits a rigid holding of the indoor motor.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A unit type air conditioner comprising:

a base plate in a bottom part thereof;

a front panel forming a front exterior of the air conditioner, having a discharge opening in an upper part thereof;

a discharge frame in the discharge opening for controlling flow of the air discharged into the room;

a barrier on a center part of the base plate which divides the base plate into indoor side base and an outdoor side base;

an air guide on the indoor side base, having an indoor fan mounted therein;

a discharge guide for guiding the air passed through the air guide to the discharge frame wherein the discharge guide includes a first rim that engages the discharge frame.

2. The unit type air conditioner as claimed in claim 1, wherein the discharge guide has an upper section larger than a lower section.

3. The unit type air conditioner as claimed in claim 1, wherein the discharge guide includes a plurality of fastening parts that engages with the front panel, and wherein the first rim engages the discharge frame in an upper part thereof.

4. The unit type air conditioner as claimed in claim 1, wherein the discharge guide includes a second rim in a lower part thereof, and the air guide includes mounting ribs to be engaged with the second rim.

5. A unit type air conditioner comprising:

a base plate in a bottom part thereof;

a front panel forming a front exterior of the air conditioner, having a discharge opening in an upper part thereof;

a discharge frame in the discharge opening for controlling flow of air discharged into a room;

a barrier on a center part of the base plate which divides the base plate into indoor side base and an outdoor side base;

an upper air guide, and a lower air guide on an indoor side of the base, having an indoor fan mounted therein, for guiding air drawn therein by the indoor fan, wherein the lower air guide includes a first motor supporting part for holding an end of an indoor motor connected to the indoor fan and the upper air guide includes a second motor supporting part that engages the first motor supporting part.

6. The unit type air conditioner as claimed in claim 5, wherein the indoor fan has one side connected to the indoor motor, and the other side held at a bearing assembly.

7. The unit type air conditioner as claimed in claim 6, wherein the bearing assembly includes a bearing and a bearing cover surrounding the bearing.

8. The unit type air conditioner as claimed in claim 6, wherein the bearing assembly is held in both the upper and lower air guide.

9. The unit type air conditioner as claimed in claim 8, wherein the lower air guide includes a semi-circular supporting part for holding the bearing assembly, and the upper air guide includes a second supporting part engaged with the semi-circular supporting part.

10. The unit type air conditioner as claimed in claim 9, wherein the first supporting part includes a circumferential extension projected therefrom for holding the bearing assembly in place, and the second supporting part includes a circular slot which engages the circumferential extension.

11. The unit type air conditioner as claimed in claim 9, wherein the semi-circular supporting part includes a flat surface in an upper part or a lower part.

12. The unit type air conditioner as claimed in claim 9, wherein each of the first and second supporting parts includes a semi-circular projection for insertion into the bearing assembly.

13. The unit type air conditioner as claimed in claim 12, wherein the bearing assembly includes an insertion groove in an outside circumferential surface thereof.

14. The unit type air conditioner as claimed in claim 5, wherein the lower air guide includes guide parts in a lower part thereof, and the upper air guide includes channel parts slidably inserted in the guide parts.

15. The unit type air conditioner as claimed in claim 5, wherein the lower air guide includes tips on upper parts of opposite side surfaces, and the upper air guide includes fastening holes engaged with the tips.

16. The unit type air conditioner as claimed in claim 5, wherein the lower air guide includes guide parts in a lower part thereof, and the upper guide includes inwardly bent stepped parts for slidably inserting into the guide parts.

17. The unit type air conditioner as claimed in claim 6, wherein the first motor supporting part is semi-circular.

18. The unit type air conditioner as claimed in claim 6, wherein the indoor motor is mounted on an indoor motor mounting part having a semi-circular mounting surface.

19. A unit type air conditioner comprising:

a base plate in a bottom part thereof, a front panel forming a front exterior of the air conditioner, having a discharge opening in an upper part thereof;

a discharge frame in the discharge opening for controlling flow of the air discharged into the room;

a barrier on a center part of the base plate which divides the base plate into an indoor side base and an outdoor side base;

an air guide on the indoor side base, having an indoor fan mounted therein; and a discharge frame having grill parts disposed at opposite sides of the discharge frame for discharging air guided to a discharge opening by the air guide to opposite sides of the discharge frame, and a discharge grill between the grill parts for controlling an air flow direction.

20. The unit type air conditioner as claimed in claim 19, wherein the discharge grill is detachable.

21. The unit type air conditioner as claimed in claim 19, wherein the discharge grill includes a plurality of horizontal bars and vertical ribs under the horizontal bars for guiding air flow.

22. A unit type air conditioner comprising:

a base plate in a bottom part thereof;

a front panel forming a front exterior of the air conditioner, having a discharge opening in an upper part thereof;

a discharge frame in the discharge opening for controlling flow of air discharged into a room;

a barrier on a center part of the base plate which divides the base plate into an indoor side base and an outdoor side base;

an air guide on the indoor side base, having an indoor fan mounted therein;

a control box at a side of the air guide, having a body for fitting electric components therein, and a first cover for selective opening/closing of the body wherein the first cover includes a first holding cart for holding a capacitor therein.

23. The unit type air conditioner as claimed in claim 22, wherein the body includes first hooks, and the first cover includes first fastening slots for fastening with the first hooks.

24. The unit type air conditioner as claimed in claim 22, wherein the first cover further includes a second holding part for fixing wires connected to the capacitor.

25. The unit type air conditioner as claimed in claim 24, wherein the first holding part includes:

a base plate for supporting a bottom of the capacitor; and a holder for surrounding an outside circumferential surface of the capacitor.

26. The unit type air conditioner as claimed in claim 24, wherein the second holding part includes a detachable second cover fitted thereto for protecting wires.

27. The unit type air conditioner as claimed in claim 26, wherein the second holding part includes a second hook on a top thereof, and the second cover includes a second fastening slot on a top thereof for fastening to the second hook.

28. The unit type air conditioner as claimed in claim 26, wherein the second holding part includes first fastening members in a lower part thereof, and the second cover includes second fastening members for fastening to the first fastening members.

29. The unit type air conditioner as claimed in claim 28, wherein the first fastening member includes a stopper projecting from an underside thereof, and the second fastening member includes an inserting channel for inserting the first fastening member, and a cut away part for holding the stopper.

30. The unit type air conditioner as claimed in claim 22, wherein the indoor motor has one side connected to the indoor fan, and the other side held at the control box.

31. The unit type air conditioner as claimed in claim 30, wherein the control box includes:

a body for fitting electric components therein, having a motor cover for holding the indoor motor; and a first cover for selective opening/closing of the body.

* * * * *